US011581674B2

(12) United States Patent
Tracy et al.

(10) Patent No.: US 11,581,674 B2
(45) Date of Patent: Feb. 14, 2023

(54) STACKED DUAL CONNECTOR SYSTEM

(71) Applicant: TE CONNECTIVITY SERVICES GMBH, Schaffhausen (CH)

(72) Inventors: Nathan Lincoln Tracy, Harrisburg, PA (US); David Patrick Orris, Middletown, PA (US); Chad William Morgan, Carneys Point, NJ (US); Lucas Arthur Benson, Camp Hill, PA (US); Linda Ellen Shields, Mechanicsburg, PA (US)

(73) Assignee: TE CONNECTIVITY SOLUTIONS GmbH, Schaffhausen (CH)

( * ) Notice: Subject to any disclaimer, the term of this patent is extended or adjusted under 35 U.S.C. 154(b) by 0 days.

(21) Appl. No.: 17/569,767

(22) Filed: Jan. 6, 2022

(65) Prior Publication Data

US 2022/0131294 A1 Apr. 28, 2022

Related U.S. Application Data

(63) Continuation of application No. 16/831,983, filed on Mar. 27, 2020, now Pat. No. 11,223,147, which is a (Continued)

(51) Int. Cl.

| | |
|---|---|
| ***H01R 12/73*** | (2011.01) |
| ***H01R 13/516*** | (2006.01) |
| ***H01R 25/00*** | (2006.01) |
| ***H01R 24/60*** | (2011.01) |
| ***H01R 13/514*** | (2006.01) |

(Continued)

(52) U.S. Cl.

CPC ..... *H01R 12/73* (2013.01); *H01R 12/707* (2013.01); *H01R 12/7064* (2013.01); *H01R 13/516* (2013.01); *H01R 13/6461* (2013.01); *H01R 24/60* (2013.01); *H01R 25/006* (2013.01); *H01R 13/514* (2013.01)

(58) Field of Classification Search

CPC ..... H01R 13/659; H01R 13/6461; H01R 13/516; H01R 13/518; H01R 24/60; H01R 12/707; H01R 12/7064; H01R 12/73; H01R 12/721

See application file for complete search history.

(56) References Cited

U.S. PATENT DOCUMENTS

| | | | |
|---|---|---|---|
| 5,030,115 | A | 7/1991 | Regnier et al. |
| 6,099,349 | A | 8/2000 | Boutros |

(Continued)

FOREIGN PATENT DOCUMENTS

| | | | |
|---|---|---|---|
| CN | 10193915 | A1 | 12/2007 |

OTHER PUBLICATIONS

Chinese Search Report for Application No. 2019100186446 dated Oct. 27, 2021 (3 pages).

*Primary Examiner* — Briggitte R. Hammond

(57) ABSTRACT

An electrical connector includes a housing and a plurality of electrical conductors held within the housing. The housing includes a mating shroud protruding forward from a front wall of the housing and defining a port that receives a mating circuit card therein. Each of the electrical conductors includes a mating contact disposed within the mating shroud and a mounting contact that projects beyond a bottom end of the housing to electrically connect to a circuit board. The mounting contacts are located within a termination area of the electrical connector.

19 Claims, 5 Drawing Sheets

Related U.S. Application Data continuation of application No. 15/867,163, filed on Jan. 10, 2018, now Pat. No. 10,630,010.

(51) Int. Cl.
*H01R 12/70* (2011.01)
*H01R 13/6461* (2011.01)

(56) References Cited

U.S. PATENT DOCUMENTS

| | | | | |
|---|---|---|---|---|
| 6,179,651 | B1 * | 1/2001 | Huang | H01R 12/724 439/541.5 |
| 6,244,896 | B1 | 6/2001 | Boutros | |
| 6,375,496 | B1 | 4/2002 | Casey et al. | |
| 6,554,641 | B1 | 4/2003 | Wu | |
| 6,612,867 | B1 | 9/2003 | Wu | |
| 6,663,423 | B2 | 12/2003 | Belopolsky | |
| 6,666,717 | B1 | 12/2003 | Choy | |
| 6,672,899 | B2 | 1/2004 | Morita et al. | |
| 6,682,365 | B1 | 1/2004 | Walker et al. | |
| 6,821,144 | B2 | 11/2004 | Choy | |
| 7,249,966 | B2 | 7/2007 | Long | |
| 7,402,077 | B2 | 7/2008 | Shindo | |
| 7,651,371 | B2 | 1/2010 | Yi et al. | |
| 7,824,197 | B1 | 11/2010 | Westman et al. | |
| 8,342,881 | B2 | 1/2013 | Lang et al. | |
| 9,028,281 | B2 | 5/2015 | Kirk et al. | |
| 2012/0196477 | A1 | 8/2012 | Nichols et al. | |

* cited by examiner

STACKED DUAL CONNECTOR SYSTEM

CROSS-REFERENCE TO RELATED APPLICATIONS

This application is a continuation of U.S. application Ser. No. 16/831,983, filed 27 Mar. 2020 (now U.S. Pat. No. 11,223,147, issued 11 Jan. 2022) which is a continuation of U.S. application Ser. No. 15/867,163, which was filed 10 Jan. 2018 (now U.S. Pat. No. 10,630,010, issued 21 Apr. 2020), the entire disclosures of which are incorporated herein by reference.

BACKGROUND OF THE INVENTION

The subject matter herein relates generally to electrical connectors that may be stacked such that one of the connectors at least partially nests within a cavity of another connector.

Some electrical connectors and connector assemblies include multiple ports for electrically connecting to multiple mating connectors. Typically the multiple ports are packaged in a unitary, one-piece connector housing. However, some connectors are configured to be stacked on another connector to define a hybrid or dual connector system. Each of the connectors in the dual connector system may include one or more ports. Relative to unitary, one-piece multi-port connectors, the dual connector systems offer more flexibility in uses and applications. For example, the discrete connectors in the dual connector systems may be configured to be utilized individually (as independent and separate single port connectors) or together as the dual connector system.

In a hypothetical example, a system with one or more single port connectors mounted on a circuit board may require a multiple-port connection interface, such as if there is insufficient available space along an edge of the circuit board to add another single port connector adjacent to the existing connectors. Using a unitary, one-piece multi-port connector may be undesirable and costly because it requires replacing one of the existing single port connectors with a new one-piece multi-port connector. A dual connector system may be preferable in this hypothetical example because the upper or "stacking" connector of the dual connector system may be able to be mounted over an existing single port board-mounted connector as a retrofit without requiring purchase of a new one-piece multi-port connector and without replacing an existing connector.

The signal transmission performance of multi-port connectors, including both unitary multi-port connectors and dual connector systems, may suffer at high signal speeds due to electrical interference and insertion loss. For example, the signal conductors extending from the upper port(s) to the circuit board are longer than the signal conductors extending from the lower port(s) to the circuit board. The elongated signal conductors may be more susceptible to electrical interference, such as crosstalk, and return loss along the lengths of the signal conductors than the shorter signal conductors.

A need remains for providing a stacked dual connector system with improved signal transmission performance at high signal speeds.

BRIEF DESCRIPTION OF THE INVENTION

With those needs in mind, one or more embodiments of the present disclosure provide an electrical connector that includes a housing and a plurality of electrical conductors.

The housing includes a front wall and a mating shroud protruding forward from the front wall. The mating shroud defines a port configured to receive a mating circuit card therein. The electrical conductors are held within the housing and are secured in position relative to one another. Each of the electrical conductors includes a mating contact that is disposed within the mating shroud and a mounting contact that projects beyond a bottom end of the housing. The mounting contacts are located within a termination area of the electrical connector and are configured to electrically connect to a circuit board. The housing defines a nesting cavity extending rearward from the front wall along the bottom end. The nesting cavity is disposed between the mating shroud and the termination area along a longitudinal axis of the electrical connector. The nesting cavity is configured to accommodate a discrete, second connector that is mounted to the circuit board.

In one or more embodiments of the present disclosure, a stacked dual connector system is provided that includes a first connector and a second connector. The first connector includes a housing and a plurality of electrical conductors held within the housing. The housing includes a front wall and two side walls extending rearward from the front wall. The housing includes an upper mating shroud protruding forward from the front wall and defining a port configured to receive a first mating circuit card therein. Each of the electrical conductors includes a mating contact disposed within the upper mating shroud and a mounting contact that projects beyond a bottom end of the housing to electrically connect to a circuit board. The housing defines a nesting cavity disposed between the circuit board and the upper mating shroud. The nesting cavity extends rearward from the front wall along the bottom end of the housing. The second connector includes a housing and a plurality of electrical conductors held within the housing. The housing of the second connector includes a base portion and a lower mating shroud that extends from a front wall of the base portion. The lower mating shroud defines a port configured to receive a second mating circuit card therein. The base portion is disposed within the nesting cavity of the first connector, and the lower mating shroud is disposed outside of the nesting cavity.

In one or more embodiments of the present disclosure, an electrical connector is provided that includes a housing and a plurality of electrical conductors held within the housing. The housing includes a front wall and a mating shroud protruding forward from the front wall. The mating shroud defines a port configured to receive a mating circuit card therein. The housing defines a nesting cavity extending rearward from the front wall along a bottom end of the housing. The nesting cavity is spaced apart vertically from the mating shroud and is configured to accommodate a discrete, second connector therein such that the mating shroud is disposed above the second connector. Each of the electrical conductors includes a mating contact disposed within the mating shroud and a mounting contact that projects beyond the bottom end of the housing to electrically connect to a circuit board. The electrical conductors are arranged as outer conductors and inner conductors. The mating contacts of the outer and inner conductors are configured to engage opposite sides of the mating circuit card. The mounting contacts of the inner conductors are disposed between the nesting cavity and the mounting contacts of the outer conductors along a longitudinal axis of the electrical connector. A pitch defined between the outer conductors and the inner conductors increases along lengths of the electrical conductors from the mating contacts to the mounting contacts such that the pitch is greater at the mounting contacts than at the mating contacts.

DETAILED DESCRIPTION OF THE INVENTION

Embodiments of the present disclosure provide a novel and non-obvious stacked dual connector system that remedies or at least diminishes the signal transmission issues associated with known multi-port connectors and stacked connector at high signal transmission speeds. For example, the upper or stacking connector in the dual connector system defines a nesting cavity that receives at least a portion of a lower or compact connector therein. The stacking connector according to one or more embodiments described herein may be more expansive relative to the size of the nesting cavity than known stacked dual connector systems. The expansive size of the stacking connector may allow the elongated signal conductors within the stacking connector to be more spaced apart from each other and from the signal conductors of the compact connector than known stacked dual connector systems. The increased space afforded to the elongated signal conductors may improve electrical performance of the dual connector system by increasing the electrical isolation of the signal conductors and/or providing more room to accommodate shielding components around the signal conductors.

Figure 1:
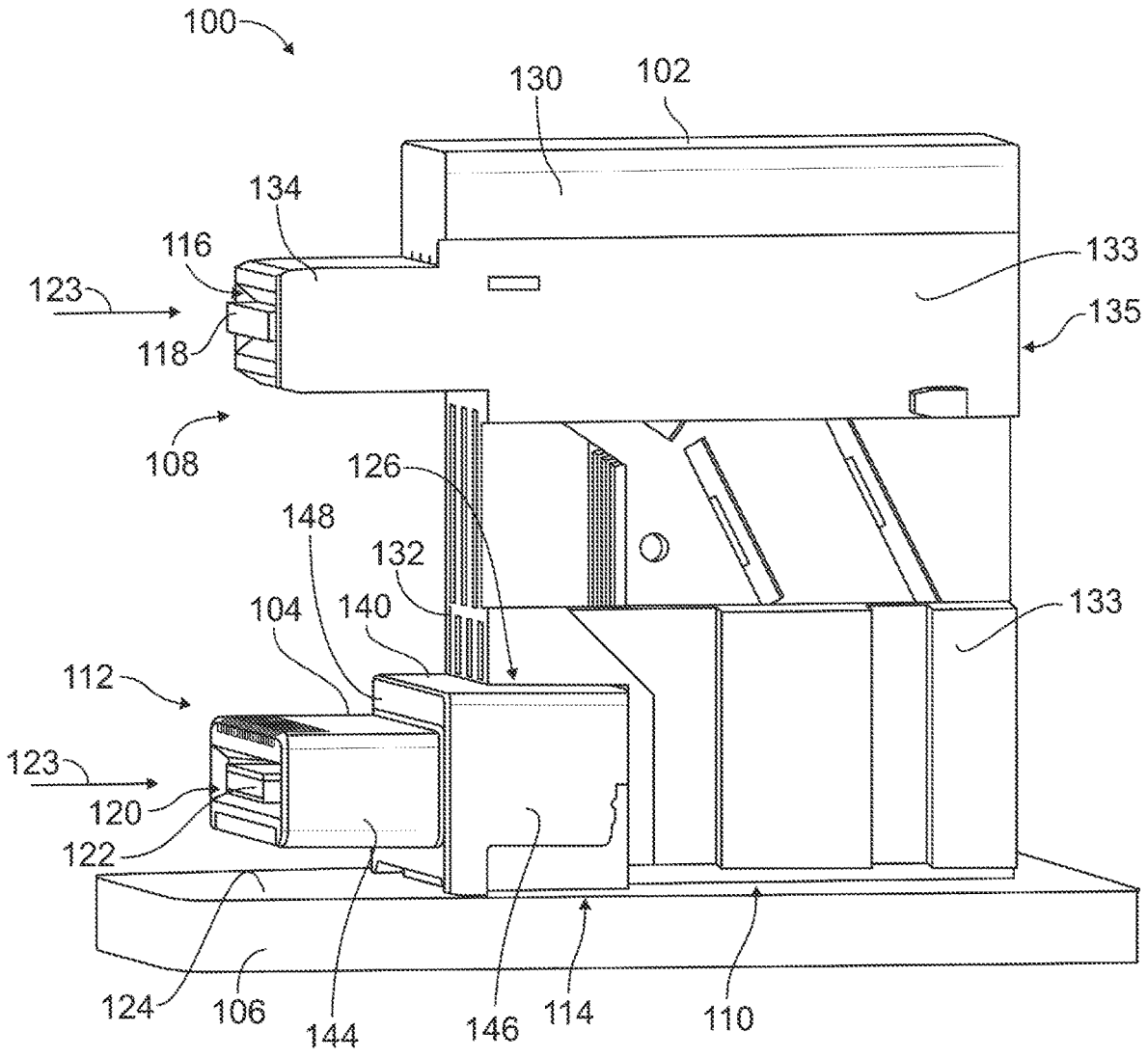
FIG. 1 is a perspective view of a stacked dual connector system according to an embodiment.

FIG. 1 is a perspective view of a stacked dual connector system 100 according to an embodiment. The stacked dual connector system 100 includes a first electrical connector 102 and a second electrical connector 104. The electrical connectors 102, 104 are discrete from one another and are each independently mounted to a common circuit board 106. The first electrical connector 102 is larger and/or more expansive than the second electrical connector 104, at least in the vertical and longitudinal dimensions shown in FIG. 1.

The first connector 102 includes a mating end 108 and a mounting end 110. The second connector 104 also includes a respective mating end 112 and a respective mounting end 114. The mating ends 108, 112 of the connectors 102, 104 each include at least one mating interface configured to engage a corresponding mating connector. In the illustrated embodiment, the first connector 102 defines a first port 116 configured to receive a first mating circuit card 118 therein to electrically connect the first connector 102 to the first mating circuit card 118. The second connector 104 defines a second port 120 configured to receive a second mating circuit card 122 therein to electrically connect the second connector 104 to the second mating circuit card 122. The second port 120 is disposed between the circuit board 106 and the first port 116 along a height of the stacked dual connector system 100. As a result, the first port 116 is referred to herein as an upper port 116, and the second port 120 is referred to as a lower port 120. The mounting ends 110, 114 of the first and second connectors 102, 104 engage and mount to the circuit board 106.

Each of the first and second mating circuit cards 118, 122 may be a component of a corresponding mating connector (not shown), such as a cable-mounted plug connector. For example, the first mating circuit card 118 may be a component of a first input/output (I/O) transceiver module (not shown), and the second mating circuit card 122 may be a component of a second I/O transceiver module (not shown). The I/O transceiver modules may be configured to transmit information in the form of electrical signals and/or optical signals.

In one or more embodiments, the first and second connectors 102, 104 are right angle connectors. For example, the mating end 108 of the first connector 102 may be oriented perpendicular to the respective mounting end 110, and the mating end 112 of the second connector 104 is oriented perpendicular to the respective mounting end 114. The mating ends 108, 112 of the two connectors 102, 104 are disposed adjacent to the respective mounting ends 110, 114 in the illustrated embodiment. Since the connectors 102, 104 are right angle connectors, the upper and lower ports 116, 120 receive the corresponding first and second mating circuit cards 118, 122 therein along a loading direction 123 that is parallel to a top side 124 of the circuit board 106.

The first electrical connector 102 defines a nesting cavity 126 at a corner of the connector 102 defined generally by the mating end 108 and the mounting end 110. The second connector 104 is partially disposed within the nesting cavity 126 of the first connector 102 such that the second connector 104 is nested within the first connector 102. The first connector 102 is stacked over and around at least a portion of a perimeter of the second connector 104. As used herein, the first electrical connector 102 is referred to as a stacking connector 102, and the second electrical connector 104 is referred to as a nesting connector 104. The stacking connector 102 may or may not engage the nesting connector 104 within the nesting cavity 126.

The stacking connector 102 includes a housing 130 and a plurality of signal conductors 128 (shown in FIG. 3) held within the housing 130. The housing 130 includes a front wall 132 and two side walls 133 extending from opposite edges of the front wall 132 to a rear end 135 of the housing 130. Only one of the two side walls 133 is visible in FIG. 1. In the illustrated embodiment, the housing 130 includes a mating shroud 134 extending forward from the front wall 132. The mating shroud 134 may represent the mating end 108 of the stacking connector 102. The mating shroud 134 defines the upper port 116 and is referred to herein as an upper mating shroud 134. The nesting cavity 126 is a recess or cutout region that extends rearward from the front wall 132.

The nesting connector 104 includes a housing 140 and a plurality of signal conductors 138 (shown in FIG. 5) held within the housing 140. The housing 140 includes a base portion 146 and a mating shroud 144. The mating shroud 144 projects forward from a front wall 148 of the base portion 146 and may represent the mating end 112 of the nesting connector 104. The mating shroud 144 defines the lower port 120 and is referred to herein as a lower mating shroud 144. The base portion 146 of the housing 140 is disposed within the nesting cavity 126 of the stacking connector 102. The lower mating shroud 144, as shown in FIG. 1, may be outside of the nesting cavity 126. The lower mating shroud 144 extends parallel to the upper mating shroud 134 and may at least partially align with the upper mating shroud 134 (e.g., the upper mating shroud 134 at least partially overlaps the lower mating shroud 144).

Although the connectors 102, 104 are shown in a nested configuration in FIG. 1 to provide multiple stacked ports 116, 120, it is recognized that the connectors 102, 104 are discrete and may be used separately from one another in other configurations.

Figure 2:
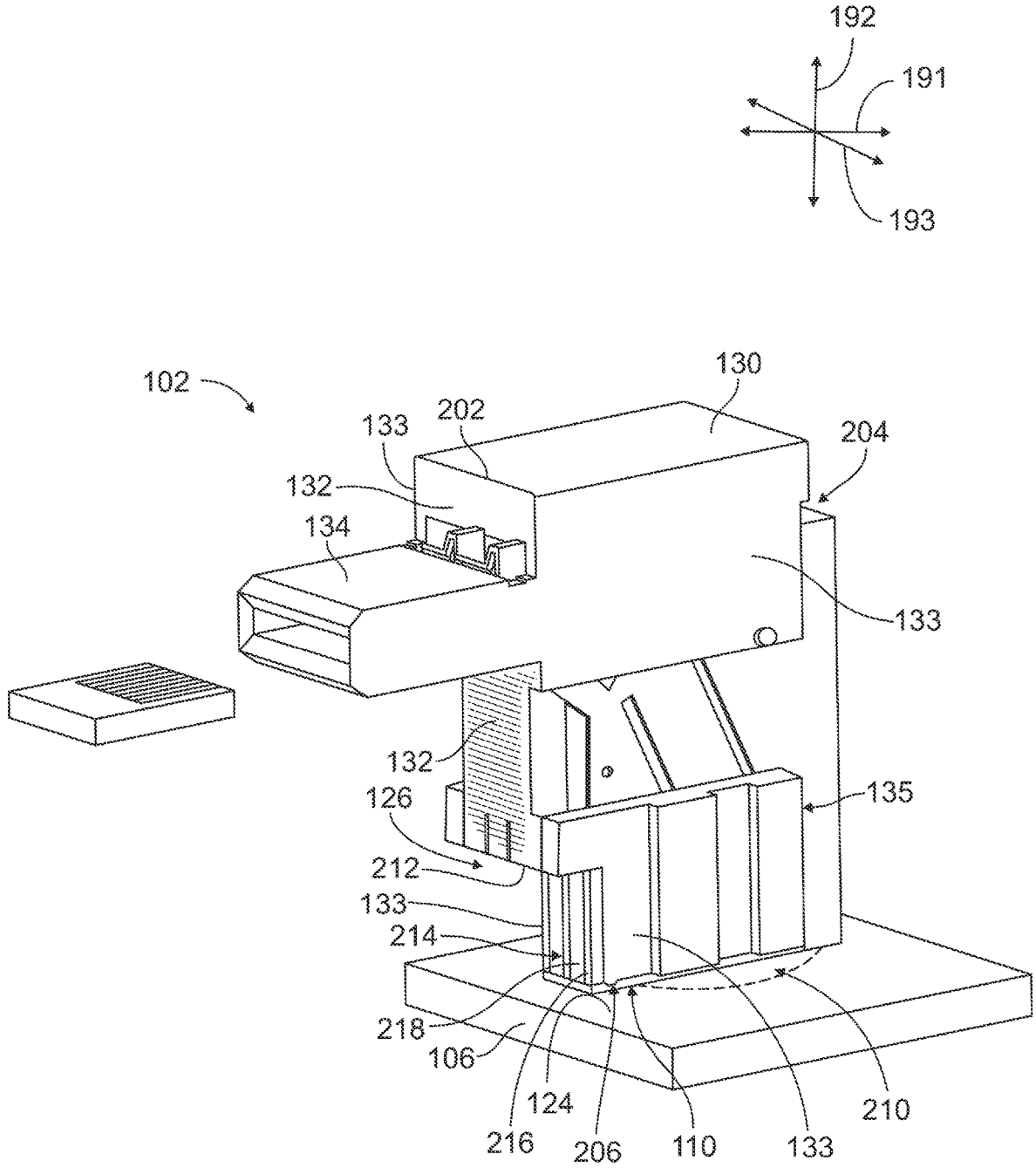
FIG. 2 is a perspective view of a first electrical connector of the stacked dual connector system mounted on a circuit board according to an embodiment.

FIG. 2 is a perspective view of the first electrical connector 102 (e.g., the stacking connector 102) of the stacked dual connector system 100 (shown in FIG. 1) mounted on the circuit board 106 according to an embodiment. The nesting connector 104 (FIG. 1) of the stacked dual connector system 100 is not shown in FIG. 2. The stacking connector 102 is oriented with respect to a longitudinal or depth axis 191, a vertical axis 192, and a lateral axis 193. The axes 191-193 are mutually perpendicular. Although the vertical axis 192 appears to extend in a vertical direction parallel to gravity in FIG. 3, it is understood that the axes 191-193 are not required to have any particular orientation with respect to gravity.

The housing 130 in the illustrated embodiment includes the front wall 132, the two side walls 133, and a top wall 202. The two side walls 133 and the top wall 202 each extend rearward from different corresponding edges of the front wall 132 to the rear end 135 of the housing 130. As used herein, relative or spatial terms such as "top," "bottom," "upper," "lower," "front," and "rear" are only used to distinguish the referenced elements and do not necessarily require particular positions or orientations in the surrounding environment of the stacking connector 102 and/or the stacked dual connector system 100 (shown in FIG. 1). The walls 132, 133, 202 define a chamber 204 therebetween. The signal conductors 128 (shown in FIG. 3) of the stacking connector 102 are held within the chamber 204. As described herein, segments of the signal conductors 128 may project out from the chamber 204.

The two side walls 133 extend from opposite edges of the front wall 132. The top wall 202 extends between and is connected to both of the two side walls 133. The housing 130 includes a bottom end 206 at (or proximate to) the mounting end 110. The bottom end 206 is located at an opposite end of the housing 130 relative to the top wall 202. The bottom end 206 faces the circuit board 106, and optionally engages the top side 124 of the circuit board 106. The bottom end 206 of the housing 130 may be open to provide space for the signal conductors 128 to project out of the chamber 204 to engage and electrically connect (e.g., terminate) to the circuit board 106. Thus, the bottom end 206 may be defined by the two side walls 133. Alternatively, the housing 130 may include a bottom wall at the bottom end 206, and the signal conductors 128 may extend through openings in the bottom wall to terminate to the circuit board 106. Optionally, the rear end 135 of the housing 130 may also be open to provide space for loading the signal conductors 128 into the chamber 204. Alternatively, the housing 130 may include a rear wall at the rear end 135, such that the signal conductors 128 may be loaded into the chamber 204 through the bottom end 206.

The stacking connector 102 mounts to the circuit board 106 at a termination zone or area 210 along the mounting end 110 of the connector 102. For example, the signal conductors 128 (shown in FIG. 3) project from the housing 130 and terminate to the circuit board 106 within the termination area 210. In the illustrated embodiment, the termination area 210 is disposed rearward of the nesting cavity 126. The nesting cavity 126 may be disposed between the upper mating shroud 134 and the termination area 210 along the longitudinal axis 191 of the connector 102. For example, the upper mating shroud 134 may be located in front of the nesting cavity 126, and the termination area 210 is rearward of the nesting cavity 126.

The nesting cavity 126 in the illustrated embodiment extends along both the front wall 132 and the bottom end 206 of the housing 130. For example, the nesting cavity 126 is a recess or cutout region at a would-be interface or corner between the front wall 132 and the bottom end 206. The nesting cavity 126 extends rearward from the front wall 132 (e.g., towards the rear end 135) and upward from the bottom end 206 (e.g., towards the top wall 202). The nesting cavity 126 may be referred to herein as extending "along" the bottom end 206 and/or "along" the front wall 132 because the nesting cavity 126 extends a depth along the bottom end 206 and a height along the front wall 132. In an embodiment, the nesting cavity 126 includes a ceiling 212 that extends rearward from the front wall 132 and defines an upper end of the nesting cavity 126. The nesting cavity 126 also includes a back end 214 that extends upward from the bottom end 206 to the ceiling 212. The ceiling 212 faces the circuit board 106. In an embodiment, the ceiling 212 is a discrete wall of the housing 130, and the back end 214 is not a discrete wall of the housing 130. For example, the back end 214 may be defined by front edges 216 of the side walls 133 and one or more dielectric bodies 218 within the chamber 204 between the side walls 133. The dielectric bodies 218 engage and hold the signal conductors 128 in place. In one or more alternative embodiments, the back end 214 may include a discrete wall and/or the ceiling 212 may lack a discrete wall.

The housing 130 may include one or more dielectric materials, such as one or more plastics. In one or more embodiments, the stacking connector 102 may lack metallic ground shields along or proximate to the nesting cavity 126, such as along the ceiling 212 or the back end 214. Alternatively, the stacking connector 102 may include one or more metallic ground shields along or proximate to the nesting cavity 126 to provide electrical shielding between the stacking connector 102 and the nesting connector 104 (FIG. 1).

Figure 3:
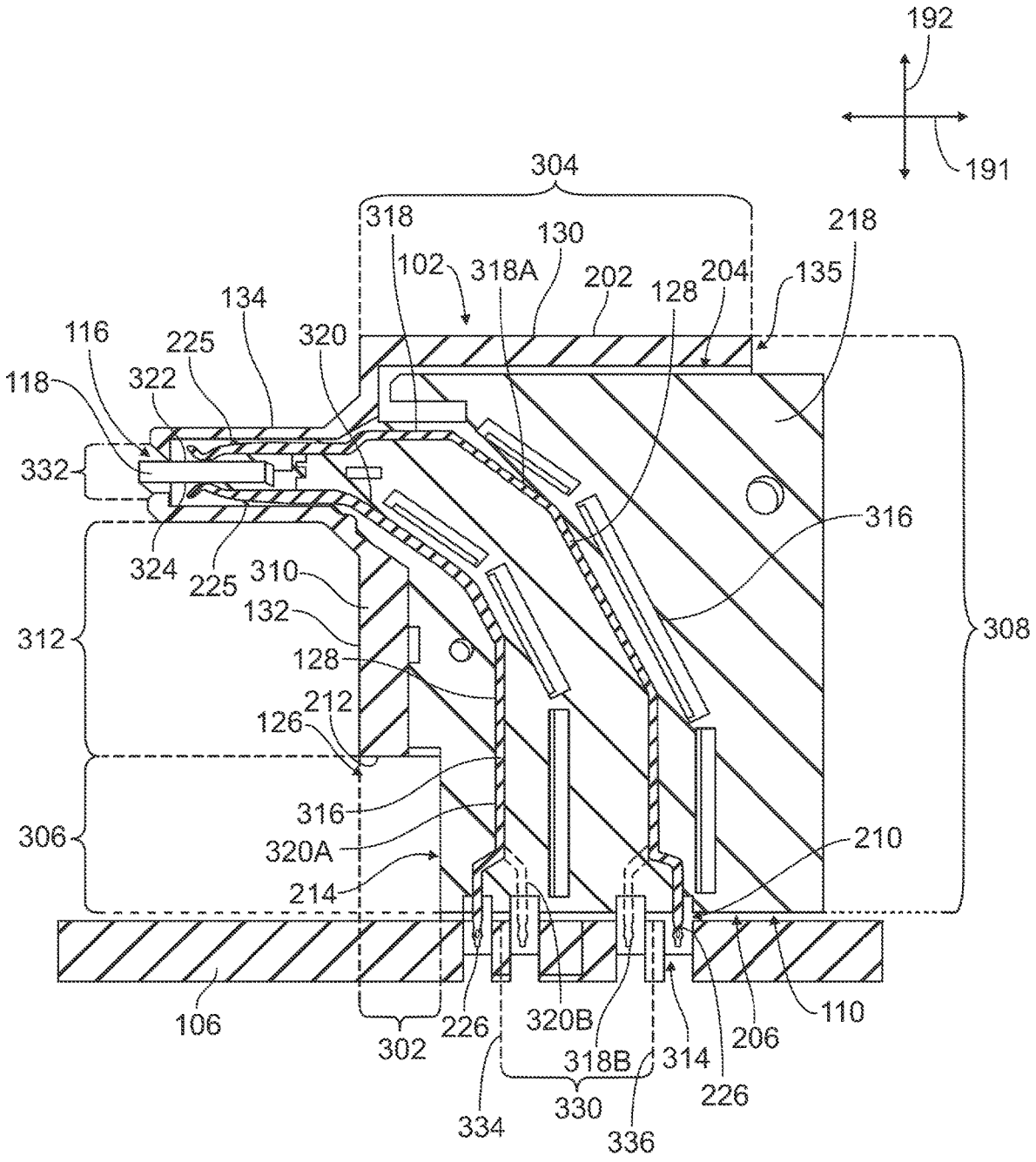
FIG. 3 is a side cross-sectional view of the first electrical connector mounted on the circuit board according to an embodiment.

FIG. 3 is a side cross-sectional view of the stacking connector 102 mounted on the circuit board 106 according to an embodiment. The cross-section line extends through the housing 130 of the stacking connector 102 and shows two signal conductors 128 of the stacking connector 102 within the chamber 204 of the housing 130. The first mating circuit card 118 is shown loaded within the port 116 of the upper mating shroud 134.

In one or more embodiments, the stacking connector 102 may be elongated vertically and/or longitudinally relative to the nesting cavity 126 to allow the signal conductors 128 to be spread out. The space between the signal conductors 128 may provide electrical isolation between the signal conductors 128, which may reduce electrical interference, such as cross-talk, and insertion loss. The size of the nesting cavity 126 may be relatively small compared to the overall size of the stacking connector 102. For example, in the illustrated embodiment, the nesting cavity 126 extends a depth 302 (e.g., parallel to the longitudinal axis 191) from the front wall 132 to the back end 214 of the nesting cavity 126. The depth 302 of the nesting cavity 126 may be less than half of a longitudinal length 304 of the housing 130 from the front wall 132 to the rear end 135. For example, the depth 302 in an embodiment may be less than one-third of the length 304 of the housing 130. The length 304 excludes the length of the upper mating shroud 134 extending forward from the front wall 132. A majority of the length of the connector 102 may be devoted to providing space for spreading out the signal conductors 128 to improve electrical signal transmission performance of the connector 102.

The nesting cavity 126 extends a height 306 (e.g., parallel to the vertical axis 192) from the bottom end 206 of the housing 130 to the ceiling 212. In an embodiment, the height 306 may be less than half of a height 308 of the housing 130 from the bottom end 206 to the top wall 202. The upper mating shroud 134 is spaced apart vertically from the ceiling 212 of the nesting cavity 126 such that an intervening section 310 of the front wall 132 extends from the ceiling 212 to the upper mating shroud 134. Optionally, the intervening section 310 may have a height 312 along the vertical axis 192 that is at least as tall as the height 306 of the nesting cavity 126.

The signal conductors 128 of the stacking connector 102 include mating contacts 225 and mounting contacts 226. The mating contacts 225 are disposed within the upper mating shroud 134, and engage and electrically connect to corresponding conductors, such as contact pads (not shown), on the circuit card 118. In the illustrated embodiment, the mating contacts 225 are deflectable spring beams that movably engage the circuit card 118. The mounting contacts 226 project from the chamber 204 beyond the bottom end 206 of the housing 130 and are terminated to the circuit board 106 within the termination area 210. In the illustrated embodiment, the mounting contacts 226 are pins that are press-fit into corresponding holes 314 (e.g., vias and/or thru-holes) in the circuit board 106 to electrically connect the signal conductors 128 to the circuit board 106. For example, the mounting contacts 226 are compliant, eye-of-the-needle pin contacts in the illustrated embodiment that allow for solderless attachment to the circuit board 106. In an alternative embodiment, the mounting contacts 226 may be soldered thru-hole pin contacts or soldered surface-mount tails instead of being press-fit. Each of the signal conductors 128 includes an intermediary segment 316 that extends through the chamber 204 from the respective mating contact 225 to the respective mounting contact 226. The signal conductors 128 may be one-piece, unitary stamped metal conductors such that the mating contacts 225 and the mounting contacts 226 are integral with the intermediary segments 316.

The signal conductors 128 may be arranged as outer signal conductors 318 and inner signal conductors 320. The mating contacts 225 of the outer and inner signal conductors 318, 320 engage opposite sides of the mating circuit card 118. For example, the mating contacts 225 of the outer signal conductors 318 engage a top side 322 of the mating circuit card 118, and the mating contacts 225 of the inner signal conductors 320 engage a bottom side 324 of the mating circuit card 118. The outer signal conductors 318 are spaced apart from the inner signal conductors 320 along the respective lengths of the conductors 318, 320. The outer signal conductors 318 are disposed along an outer perimeter of the inner signal conductors 320 relative to a curved path of the inner signal conductors 320, such that the outer signal conductors 318 may be at least slightly longer than the inner signal conductors 320. The mounting contacts 226 of the inner signal conductors 320 are disposed between the nesting cavity 126 and the mounting contacts 226 of the outer signal conductors 318 along the longitudinal axis 191.

In the illustrated embodiment, the cross-section line extends through one outer signal conductor 318A and one inner signal conductor 320A that aligns with the outer signal conductor 318A. Optionally, the intermediary segments 316 of the conductors 318A, 320A may be jogged or stepped proximate to the mounting contacts 226. Although the intermediary segments 316 of the two conductors 318A, 320A are jogged away from each other, other aligned sets of outer and inner signal conductors 318, 320 of the stacking connector 102 may be jogged towards each other. For example, the jogged portions of two outer and inner signal conductors 318B, 320B behind the signal conductors 318A, 320A are shown in phantom in FIG. 3. The signal conductors 318B, 320B are jogged towards each other at the same location that the signal conductors 318A, 320A are jogged away from each other. In an alternative embodiment, the signal conductors 318A, 320A may be jogged in the same direction as one another or may not be jogged at all.

In the illustrated embodiment, the two signal conductors 318A, 320A are held within a common dielectric body 218. For example, the dielectric body 218 may be a vertically-oriented wafer or contact module. The dielectric body 218 holds the signal conductors 318A, 320A in fixed positions relative to one another. For example, the dielectric body 218 may be overmolded onto the signal conductors 318A, 320A. The mating contacts 225 of the signal conductors 318A, 320A protrude from the dielectric body 218 to extend into the upper mating shroud 134. The mounting contacts 226 of the signal conductors 318A, 320A protrude from the dielectric body 218 at the mounting end 110 to terminate to the circuit board 106.

The outer signal conductors 318 are spaced apart from the corresponding inner signal conductors 320 that align with the outer signal conductors 318 via a pitch, which is the distance between midpoints or center points of the signal conductors 318, 320. The pitch optionally may vary along the lengths of the signal conductors 318, 320. For example, as shown in FIG. 3, the pitch between the outer signal conductor 318A and the inner signal conductor 320A increases along the lengths of the signal conductors 318A, 320A from the respective mating contacts 225 to the respective mounting contacts 226 such that the pitch 330 between the mounting contacts 226 of the two conductors 318A, 320A is greater than the pitch 332 between the mating contacts 225 of the two conductors 318A, 320A. In an embodiment, the pitch 330 between the mounting contacts 226 along the longitudinal axis 191 is greater than the depth 302 of the nesting cavity 126.

It is noted that the pitch 330 between the mounting contacts 226 is measured between the non-jogged portions of the intermediary segments 316 adjacent to the jogged portions. The midpoint 334 of the inner signal conductors 320 at the mounting contacts 226 is located at a midpoint between the mounting contact 226 of the inner conductor 320A and the mounting contact 226 of the inner conductor 320B shown in phantom. Similarly, the midpoint 336 of the outer signal conductors 318 at the mounting contacts 226 is located at a midpoint between the mounting contact 226 of the outer conductor 318A and the mounting contact 226 of the outer conductor 318B shown in phantom.

As shown in FIG. 3, the outer and inner signal conductors 318, 320 within the dielectric body 218 gradually spread farther apart from the mating contacts 225 to the mounting contacts 226. The increase in pitch may or may not be uniform along the length of the conductors 318, 320. For example, there may be segments of the conductors 318, 320 with uniform pitch, and other segments of the conductors 318, 320 in which the pitch increases with increasing proximity to the mounting contacts 226.

Figure 4:
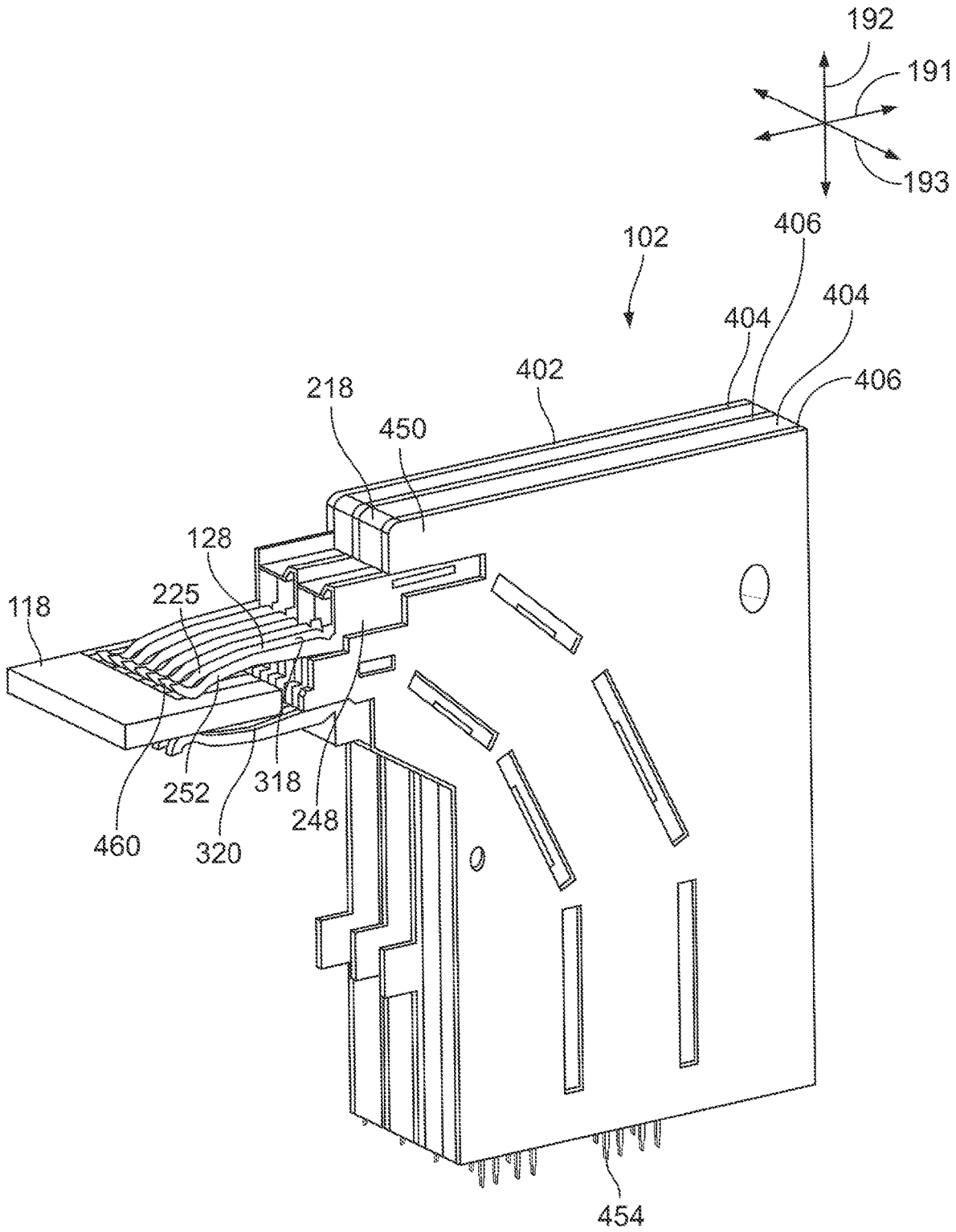
FIG. 4 is a perspective view of a module stack of the first electrical connector according to an embodiment.

FIG. 4 is a perspective view of a module stack 402 of the stacking connector 102 according to an embodiment. The module stack 402 is disposed within the chamber 204 (shown in FIG. 3) of the housing 130, although the housing 130 is not shown in FIG. 4. The module stack 402 includes a plurality of contact modules 404 and ground shields 406 arranged side by side along the lateral axis 193 between the side walls 133 (FIG. 2) of the housing 130. The ground shields 406 may be interleaved between the contact modules 404 such that the ground shields 406 alternate with the contact modules 404 along the width of the stack 402. The contact modules 404 in the illustrated embodiment are oriented parallel to each other and parallel to the longitudinal axis 191.

Each of the contact modules 404 may include a plurality of the signal conductors 128 and a respective dielectric body 218 that holds the signal conductors 128 in place. For example, the dielectric bodies 218 may surround and engage the intermediary segments 316 (FIG. 3) of the signal conductors 128. In the illustrated embodiment, the dielectric bodies 218 are oriented parallel to the side walls 133 of the housing 130. In the illustrated embodiment, each of the contact modules 404 includes four signal conductors 128. The four signal conductors 128 are arranged as a pair 460 of two adjacent outer signal conductors 318 and a pair 462 of two adjacent inner signal conductors 320. The mating contacts 225 of the pair 460 may align vertically above the mating contacts 225 of the pair 462 of the same contact module 404. Each of the pairs 460, 462 may be used to transmit differential signals.

The ground shields 406 provide shielding between adjacent contact modules 404. The ground shield 406 may be oriented parallel to the contact modules 404. The ground shields 406 include a metallic plate 448 that is optionally at least partially covered by a cover material 450 composed of one or more plastics, one or more metals, or a combination thereof (e.g., an electrically lossy material). The ground shields 406 may include mating contacts 452 that align with the mating contacts 225 of the signal conductors 128. The mating contacts 452 of the ground shields 406 may be deflectable spring beams, similar to the mating contacts 225 of the signal conductors 128. The mating contacts 452 may engage ground elements (not shown) of the mating circuit card 118 to establish a ground path between the circuit card 118 and the stacking connector 102. The ground shields 406 may also include mounting contacts 454 that are mounted to ground elements of the circuit board 106 (FIG. 1). The mating contacts 452 and the mounting contacts 454 may be integral extensions of the respective plates 448. The ground shields 406 may be electrically connected to each other across the contact modules 404, via conductive tie bars or bridges, to electrically common the ground shields 406.

In an alternative embodiment, the dielectric bodies 218 may be oriented to extend laterally along the lateral axis 193 instead of longitudinally along the longitudinal axis 191. For example, multiple dielectric bodies 218 may be stacked vertically and/or longitudinally instead of stacking the dielectric bodies 218 side by side along the lateral axis 193. In one alternative embodiment, all of the outer signal conductors 318 may be molded within a single dielectric body as a first sub-assembly, and all of the inner signal conductors may be molded within a different dielectric body as a second sub-assembly.

Figure 5:
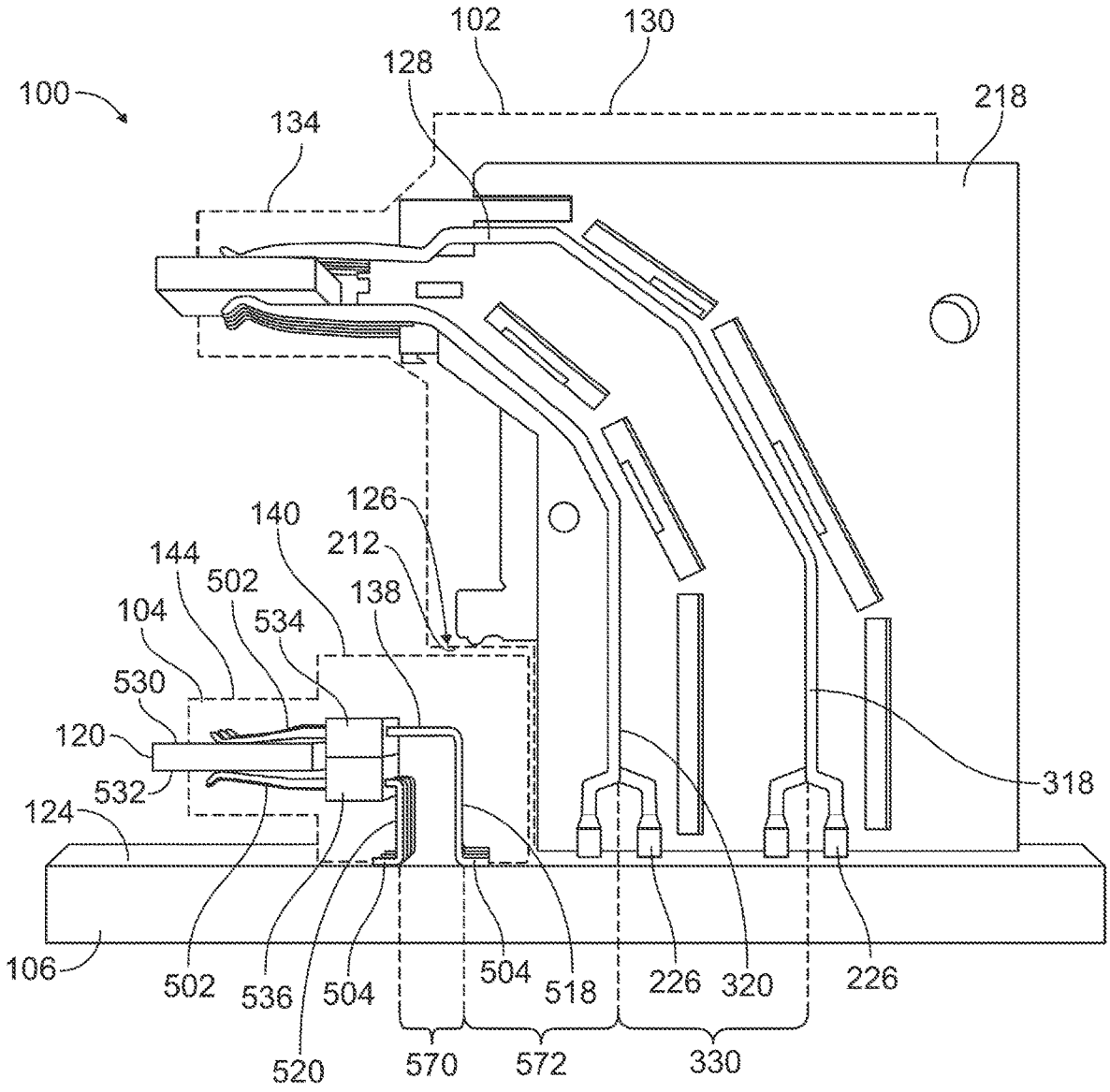
FIG. 5 is a schematic illustration of the stacked dual connector system according to an embodiment showing a housing of the first electrical connector and a housing of a second electrical connector in phantom.

FIG. 5 is a schematic illustration of the stacked dual connector system 100 according to an embodiment showing the housing 130 of the stacking connector 102 and the housing 140 of the nesting connector 104 in phantom. The signal conductors 138 of the nesting connector 104 include respective mating contacts 502 that extend into the lower mating shroud 144 and engage the second mating circuit card 120. The signal conductors 138 extend from the mating contacts 502 to respective mounting contacts 504 that are terminated to the circuit board 106. In the illustrated embodiment, the mounting contacts 504 are contact tails that are oriented parallel to the top side 124 of the circuit board 106 and are configured to be surface-mounted to the top side 124 using solder. As shown in FIG. 5, the mounting contacts 504 of the signal conductors 138 of the nesting connector 104 may differ from the mounting contacts 226 of the signal conductors 128 of the stacking connector 102, which are compliant pins that are press-fit into holes 314 (shown in FIG. 3) of the circuit board 106. In other embodiments, the mounting contacts 504 may be the same style of termination as the mounting contacts 226 or may be different but not the styles shown in FIG. 5. For example, one or more of the mounting contacts 504, 226 may be soldered thru-hole mounted.

Optionally, the lower mating shroud 144 may be located closer to the circuit board 106 than to the upper mating shroud 134 above the lower mating shroud 144. For example, the vertical distance between the top side 124 of the circuit board 106 and the lower mating shroud 144 may be less than the vertical distance between the upper and lower mating shrouds 134, 144, as shown in FIG. 5.

In the illustrated embodiment, the signal conductors 138 of the nesting connector 104 are arranged as outer signal conductors 518 and inner signal conductors 520. The mating contacts 502 of the outer signal conductors 518 engage a top side 530 of the second mating circuit card 120, and the mating contacts 502 of the inner signal conductors 520 engage a bottom side 532 of the circuit card 120. Optionally, all of the outer signal conductors 518 are held together by an upper dielectric body 534 that engages and surrounds portions of the outer signal conductors 518. Likewise, all of the inner signal conductors 520 are held together by a lower dielectric body 536 that engages and surrounds portions of the inner signal conductors 520. In an alternative embodiment, the outer and inner signal conductors 518, 520 may be held within vertically-oriented and laterally-stacked dielectric bodies, which may be similar to the dielectric bodies 218 of the stacking connector 102, as shown in FIG. 4.

The nesting connector 104 is nested within the nesting cavity 126 of the stacking connector 102 in FIG. 5. In the illustrated embodiment, the mounting contacts 504 of the outer signal conductors 518 are aligned within the nesting cavity 126, such that a portion of the ceiling 212 extends above the mounting contacts 504 of the outer single conductors 518. Although not shown in the illustrated embodiment, the mounting contacts 504 of the inner signal conductors 520 optionally may also align within the nesting cavity 126 in one or more other embodiments. In the nested configuration, the mounting contacts 504 of the nesting connector 104 and the mounting contacts 226 of the stacking connector 102 are spaced apart along the longitudinal axis 191 (shown in FIG. 3). For example, the mounting contacts 504, 226 are disposed in a sequence that includes, from front to rear, the mounting contacts 504 of the inner signal conductors 520, the mounting contacts 504 of the outer signal conductors 518, the mounting contacts 226 of the inner signal conductors 320, and the mounting contacts 226 of the outer signal conductors 318. Thus, the mounting contacts 504 of the outer signal conductors 518 of the nesting connector 104 are disposed axially between the mounting contacts 504 of the inner signal conductors 520 of the nesting connector 104 and the mounting contacts 226 of the inner signal conductors 320 of the stacking connector 102.

The inner and outer signal conductors 520, 518 of the nesting connector 104 are spaced apart from one another by a pitch. As shown in FIG. 5, the pitch 570 between the mounting contacts 504 of the nesting connector 104 is less than the pitch 330 between the mounting contacts 226 of the stacking connector 102. For example, the pitch 330 between the mounting contacts 226 may be more than double the pitch 570 in one or more embodiments. The smaller pitch 570 between the signal conductors 520, 518 of the nesting connector 104 may be permissible without causing detrimental electrical interference (e.g., cross-talk) at high signal speeds due to the relatively short lengths of the signal conductors 520, 518 relative to the signal conductors 318, 320 of the stacking connector 102.

In an embodiment, as shown in FIG. 5, a distance 572 between the mounting contacts 504 of the outer signal conductors 518 of the nesting connector 104 and the mounting contacts 226 of the inner signal conductors 320 of the stacking connector 102 may be greater than the pitch 570. Thus, the inner signal conductors 320 of the stacking connector 102 may be sufficiently spaced apart from the outer signal conductors 518 of the nesting connector 104 to prevent or at least reduce electrical interference extending across the nesting cavity 126 between the two connectors 102, 104. For example, the stacked dual connector assembly 100 optionally lacks ground shields in the area between the outer signal conductors 518 of the nesting connector 104 and the inner signal conductors 320 of the stacking connector 102. The enlarged spacing in the area, at least relative to the pitch 570 of the nesting connector 104, may provide sufficient electrical isolation without requiring ground shielding along the nesting cavity 126, which may be expensive and/or complex.

It is to be understood that the above description is intended to be illustrative, and not restrictive. For example, the above-described embodiments (and/or aspects thereof) may be used in combination with each other. In addition, many modifications may be made to adapt a particular situation or material to the teachings of the invention without departing from its scope. Dimensions, types of materials, orientations of the various components, and the number and positions of the various components described herein are intended to define parameters of certain embodiments and are by no means limiting and are merely example embodiments. Many other embodiments and modifications within the spirit and scope of the claims will be apparent to those of ordinary skill in the art upon reviewing the above description. The scope of the invention should, therefore, be determined with reference to the appended claims, along with the full scope of equivalents to which such claims are entitled. In the appended claims, the terms "including" and "in which" are used as the plain-English equivalents of the respective terms "comprising" and "wherein." Moreover, in the following claims, the terms "first," "second," and "third," etc. are used merely as labels, and are not intended to impose numerical requirements on their objects. Further, the limitations of the following claims are not written in means-plus-function format and are not intended to be interpreted based on 35 U.S.C. § 112(f), unless and until such claim limitations expressly use the phrase "means for" followed by a statement of function void of further structure.

What is claimed is:

1. A stacked dual connector system comprising:

a first connector including a first housing holding a plurality of contact modules in a contact module stack, the contact modules being stacked parallel to each other having vertical orientations, each contact module including a dielectric body holding electrical conductors, the first housing including a front wall and two side walls extending rearward from the front wall, the first housing including an upper mating shroud protruding forward from the front wall and defining a port configured to receive a first mating circuit card therein, the electrical conductors including mating contacts disposed within the upper mating shroud for engaging the first mating circuit card, the electrical conductors including mounting contacts that projects beyond a bottom end of the first housing to electrically connect to a circuit board; and a second connector including a second housing holding an upper contact assembly and a lower contact assembly, the upper contact assembly including an upper dielectric body holding a plurality of outer electrical conductors, the lower contact assembly including a lower dielectric body holding a plurality of inner electrical conductors, the upper and lower dielectric bodies being coupled together and having a horizontal orientation, the second housing of the second connector including a base portion and a lower mating shroud extending from a front wall of the base portion, the lower mating shroud defining a port configured to receive a second mating circuit card therein, the outer electrical conductors of the upper contact assembly being arranged in an outer row for engaging an upper side of the second mating circuit card, the inner electrical conductors of the lower contact assembly being arranged in an inner row for engaging a lower side of the second mating circuit card;

wherein the upper mating shroud is located above the lower mating shroud and wherein the first housing is located behind the second housing.

2. The stacked dual connector system of claim 1, wherein the lower mating shroud of the second connector is vertically disposed closer to the circuit board than to the upper mating shroud of the first connector.

3. The stacked dual connector system of claim 1, wherein the electrical conductors of the first connector are arranged as outer conductors and inner conductors configured to engage opposite sides of the first mating circuit card, wherein each contact module includes one of the outer conductors and one of the inner conductors.

4. The stacked dual connector system of claim 1, wherein the upper dielectric body holds all of the outer electrical conductors of the second connector and wherein the lower dielectric body holds all of the inner electrical conductors of the second connector.

5. The stacked dual connector system of claim 1, wherein the first housing includes a nesting cavity disposed vertically between the circuit board and the upper mating shroud, the nesting cavity extending rearward from the front wall to a back end of the nesting cavity, the nesting cavity located along the bottom end of the first housing, the second housing of the second connector being received in the nesting cavity.

6. The stacked dual connector system of claim 1, wherein the contact modules are arranged parallel to the side walls of the first housing, and wherein the upper and lower dielectric bodies are arranged parallel to front wall of the second housing.

7. The stacked dual connector system of claim 1, wherein the contact modules of the first connector are arranged perpendicular to the upper and lower dielectric bodies of the second connector.

8. The stacked dual connector system of claim 1, wherein each of the contact modules include a respective dielectric body that surrounds and engages intermediary segments of a plurality of the electrical conductors.

9. A stacked dual connector system comprising:

a first connector including a first housing holding a plurality of contact modules in a contact module stack, the contact modules being stacked parallel to each other having vertical orientations, each contact module including a dielectric body holding an outer electrical conductor and an inner electrical conductor, the outer electrical conductors of the contact modules in the contact module stack being arranged in an outer row, the inner electrical conductors of the contact modules in the contact module stack being arranged in an inner row, the first housing including a front wall and two side walls extending rearward from the front wall, the first housing including an upper mating shroud protruding forward from the front wall and defining a port configured to receive a first mating circuit card therein, the outer electrical conductors including outer mating contacts, the outer mating contacts disposed within the upper mating shroud for engaging the first mating circuit card, the inner electrical conductors including inner mating contacts, the inner mating contacts disposed within the upper mating shroud for engaging the first mating circuit card, the outer electrical conductors including outer mounting contacts that projects beyond a bottom end of the first housing to electrically connect to a circuit board, the inner electrical conductors including inner mounting contacts that projects beyond the bottom end of the first housing to electrically connect to the circuit board, the first housing further defining a nesting cavity disposed vertically between the circuit board and the upper mating shroud, the nesting cavity extending rearward from the front wall to a back end of the nesting cavity, the nesting cavity located along the bottom end of the first housing, wherein the back end of the nesting cavity is disposed in front of the mounting contacts of the electrical conductors; and a second connector including a second housing holding an upper contact assembly and a lower contact assembly, the upper contact assembly including an upper dielectric body holding a plurality of outer electrical conductors, the lower contact assembly including a lower dielectric body holding a plurality of inner electrical conductors, the upper and lower dielectric bodies being coupled together and having a horizontal orientation, the outer electrical conductors of the upper contact assembly being arranged in an outer row, the inner electrical conductors of the lower contact assembly being arranged in an inner row, the second housing of the second connector including a base portion and a lower mating shroud extending from a front wall of the base portion, the lower mating shroud defining a port configured to receive a second mating circuit card therein;

wherein the upper mating shroud is located above the lower mating shroud and wherein the second housing is located in the nesting cavity.

10. The stacked dual connector system of claim 9, wherein the lower mating shroud of the second connector is vertically disposed closer to the circuit board than to the upper mating shroud of the first connector.

11. The stacked dual connector system of claim 9, wherein each contact module includes one of the outer conductors and one of the inner conductors.

12. The stacked dual connector system of claim 9, wherein the upper dielectric body holds all of the outer electrical conductors of the second connector and wherein the lower dielectric body holds all of the inner electrical conductors of the second connector.

13. The stacked dual connector system of claim 9, wherein the contact modules are arranged parallel to the side walls of the first housing, and wherein the upper and lower dielectric bodies are arranged parallel to front wall of the second housing.

14. The stacked dual connector system of claim 9, wherein the contact modules of the first connector are arranged perpendicular to the upper and lower dielectric bodies of the second connector.

15. The stacked dual connector system of claim 9, wherein the first housing extends a length along the longitudinal axis of the first connector from the front wall to a rear end of the first housing opposite the front wall, wherein a depth of the nesting cavity along the longitudinal axis from the front wall to the back end is less than half of the length of the first housing from the front wall to the rear end.

16. The stacked dual connector system of claim 9, wherein the nesting cavity extends a height along a vertical axis of the first connector from the bottom end of the first housing to a ceiling of the nesting cavity, wherein the height of the nesting cavity is less than half of a height of the first housing along the vertical axis from the bottom end to a top wall of the first housing.

17. The stacked dual connector system of claim 9, wherein the electrical conductors of the first connector are arranged within the first housing as outer conductors and inner conductors, mating contacts of the inner and outer conductors are configured to engage opposite sides of the first mating circuit card, wherein the outer conductors are spaced apart from the inner conductors by a pitch, the pitch increasing along lengths of the electrical conductors from the mating contacts to mounting contacts configured to be mounted to the circuit board such that the pitch is greater at the mounting contacts than at the mating contacts.

18. The stacked dual connector system of claim 9, wherein each of the contact modules include a respective dielectric body that surrounds and engages intermediary segments of a plurality of the electrical conductors.

19. The stacked dual connector system of claim 9, wherein an intervening section of the front wall of the housing that extends from the mating shroud to the nesting cavity is at least as tall as a height of the nesting cavity from the bottom end of the housing to a ceiling of the nesting cavity.

* * * * *